United States Patent [19]

Johansen

[11] 3,949,054

[45] Apr. 6, 1976

[54] METHOD OF COMBUSTION OF GASEOUS FUELS AND FLUE GASES

[76] Inventor: Svend Borge Johansen, Calle Javier Vilanova 31, San Pedro de Premia, (Barcelona), Spain

[22] Filed: Apr. 23, 1974

[21] Appl. No.: 463,376

[30] Foreign Application Priority Data

Apr. 27, 1973 Denmark ..... 2324/73

[52] U.S. Cl. ..... 423/210

[51] Int. Cl.[2] ..... F23D 7/00

[58] Field of Search..... 423/210, 212; 23/277 C

[56] References Cited

UNITED STATES PATENTS

| | | | |
|---|---|---|---|
| 2,551,112 | 5/1951 | Goddard | 60/260 X |
| 3,189,416 | 6/1965 | Clarke | 60/303 X |
| 3,484,189 | 12/1969 | Hardison | 423/210 |
| 3,637,343 | 1/1972 | Hirt | 423/210 |
| 3,690,840 | 9/1972 | Volker | 423/210 X |
| 3,813,879 | 6/1974 | Fnoue et al. | 23/277 C |
| 3,827,861 | 8/1974 | Zenkner | 423/210 X |
| 3,835,645 | 9/1974 | Zoleta | 23/277 C |
| 3,838,975 | 10/1974 | Tabak | 23/277 C |
| 3,867,102 | 2/1975 | Csathy | 423/210 X |

*Primary Examiner*—L. Dewayne Rutledge
*Assistant Examiner*—Arthur J. Steiner
*Attorney, Agent, or Firm*—Haseltine, Lake & Waters

[57] ABSTRACT

A method and a reactor burner for combustion of gaseous fuels and flue gases is disclosed. The gas is mixed at a uniform temperature and then fed to a gas rotational field in a rotary symmetrical body at a suitable distance from the rotational axis and with free access for the gas to the axis of symmetry.

4 Claims, 3 Drawing Figures

METHOD OF COMBUSTION OF GASEOUS FUELS AND FLUE GASES

Figure 1:
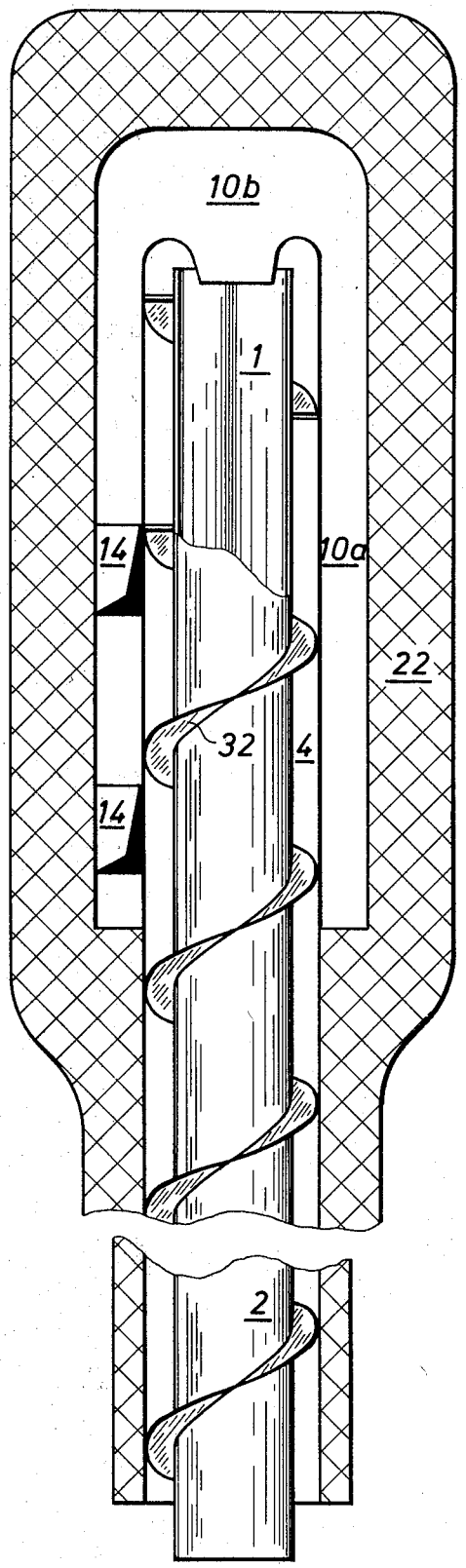

U.S. patent application Ser. No. 308,842 filed Nov. 22, 1972 relates to a method of and a reactor burner for combustion of gaseous fuels and flue gases, including exhaust gases from internal combustion engines, with the use of excess combustion air and partial thermal reflux of the heat content of the combustion products and the combustion heat to the combustion process. The essential feature of that application is that the heat content of the combustion products is partly recycled to the combustion process by heat exchange with combustion air and/or gas which may further be in mutual heat exchange, air and gas being subsequently supplied to a reaction chamber so that directly after the introduction into the reaction chamber a surface combustion takes place in a reaction zone which separates air and gas regions, by which the heat of combustion is partly transferred to air and gas by heat exchange directly before and during the said air and gas entering the reaction zone, in which they return in part to the process of combustion the heat received, the total thermal reflux being of such amount that the surface combustion is maintained thereby that the temperature of air and gas united in the reaction zone is equal to or in excess of the ignition temperature of the mixture, the surface combustion being further maintained above the ignition temperature of mixtures or carbon monoxide and air.

In one embodiment of the method according to the invention the combustion takes place in a rotary symmetrical chamber, in which there is formed a kind of gas flywheel for storing the kinetic energy of the gas in the form of rotational energy, the gas flywheel having an effect analogous to the flywheel of an internal combustion engine, but with the difference that the gas flywheel is mass-replacing, mass elements having a great momentum being introduced at the periphery of the flywheel and corresponding mass elements with a small momentum being withdrawn near the center of the eddy.

The present invention is concerned with a further development of the method according to the application for achieving a relatively greater concentration of combustion reactive components in gases and waste gases, and the said method has according to the invention the essential feature that the gas is mixed so as to have an approximately uniform temperature and then fed to a gas rotational field at suitable distance from the rotational axis, with free access for the gas to the rotational axis.

By this method, the result obtained with the use of the mass-replacing gas flywheel is that the important relative concentration of the combustion reactive components is attained which is required for achieving an efficient combustion, in particular in connection with waste gases.

Application Ser. No. 308,842 is further concerned with a reactor burner for carrying the method into effect, and the essential feature of the said burner is that it includes at least one heat exchanger and at least one reaction chamber with heat exchanger and one or more air nozzles which are likewise connected with a heat exchanger, and that at least one of the heat exchangers is adapted to be acted upon by the hot products of combustion from the reaction chamber and that the total heat exchange capacity of the burners is so great that a surface combustion between air and gas may be maintained.

Figure 2:
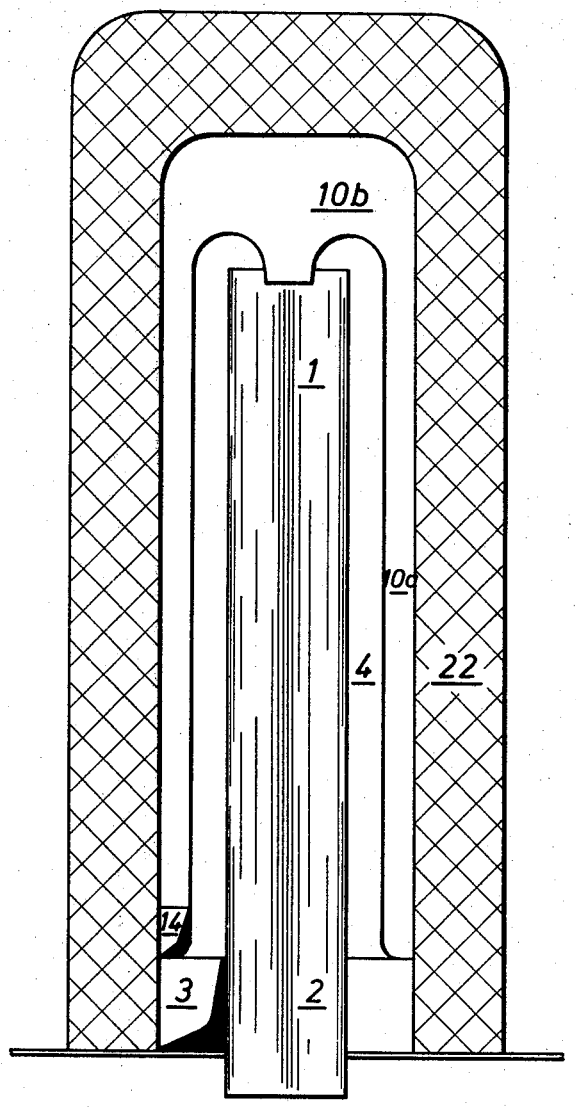
Figure 3:
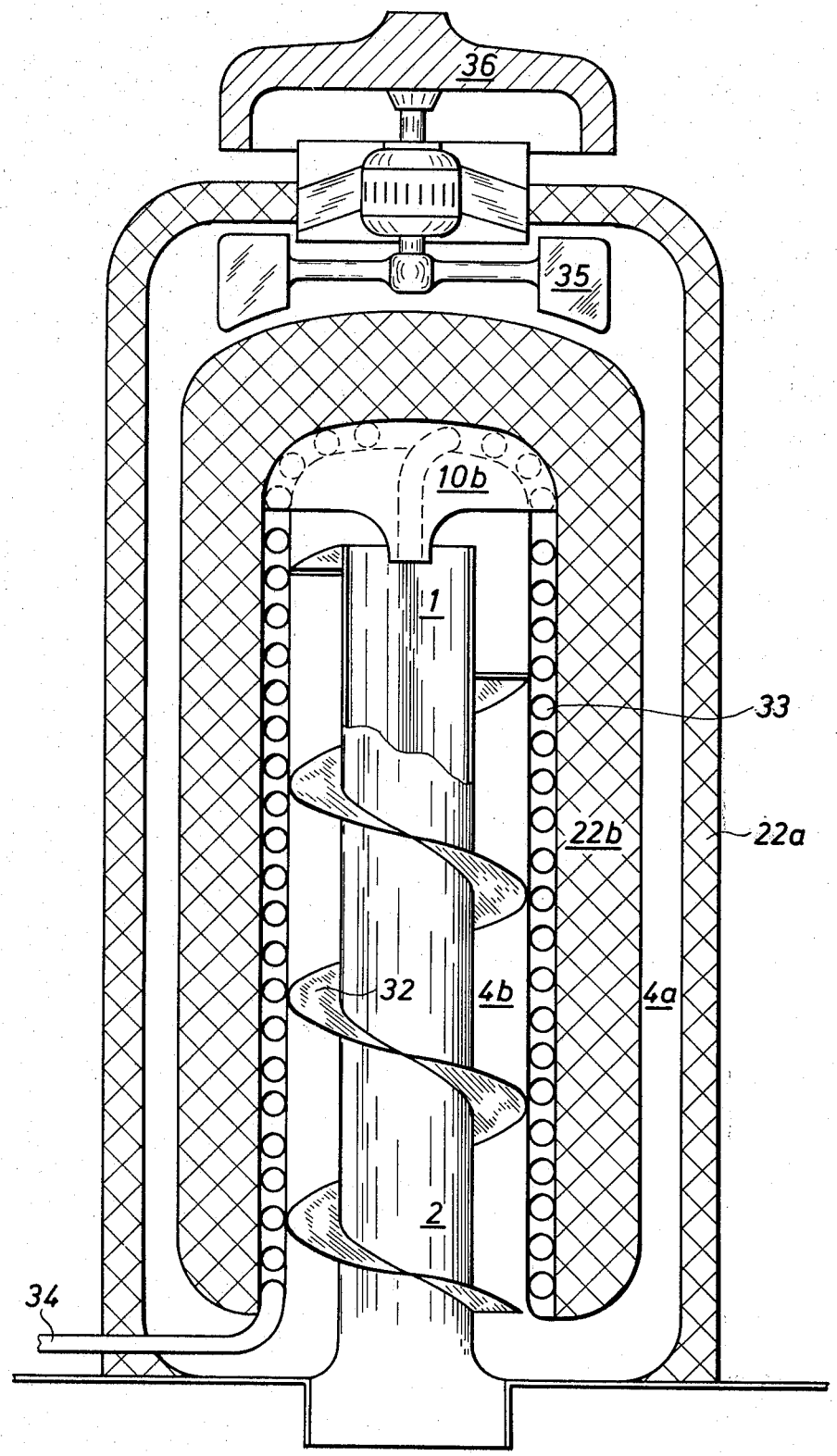

The invention and its resultant novel technical effect will be described in detail with reference to the drawing, in which FIGS. 1–3 show various embodiments of the reactor burner according to the invention.

The desired relatively greater concentration of combustion reactive components in gases and waste gases is obtained in connection with the difference in the molecular weight M of the components, as $M_{CO2}=44$, $M_{NO}=30$, $M_{CO}=28$, $M_{N2}=28$, $M_{H2O}=18$, $M_{H2}=2$.

If therefore, the waste gas is mixed so as to attain a uniform temperature, for example by rotation in the rotary symmetrical shell-formed first part 10*a* of the gas preheater, the said first part being remote from the rotational axis, there will be a continuous division of the gas in the gas rotational field in the second part 10*b* of the gas preheater with free access for the waste gas to the rotational axis, so that near the rotational axis there will be a relative increased concentration of molecules of low molecular weight or of heavier molecules with a kinetic energy greater than the average, i.e. of a temperature greater than the average temperature.

The essentially heavier inactive carbon dioxide molecules will be relatively concentrated in the outer parts of the rotational field.

Since the reductive combustion of nitric monoxide with carbon monoxide or hydrogen to form nitrogen and carbon dioxide or water is dependent upon the concentration of the reactants, the energy level and the energy barrier of the reaction, i.e. the ignition temperature, the probability of the combustion is essentially increased so that it may be expected that the reaction will preferably start near the rotational axis. The combustion heat released by the reaction is transmitted essentially to the relatively concentrated lighter molecules around the rotational axis in the rotational center, whereby the concentration and temperature profiles of the active components for combustion in the rotational field increase towards the rotational axis, which also increases the probability of the subsequent oxidative combustion of said components with a preheated excess of combustion air.

The returned heat radiation from the reaction zone of the oxidative combustion at the end of the gas preheater is substantially directed against a small area around the rotational axis and therefore, if necessary, initiates reductive combustion since the reflected radiation brings the reactants above their ignition temperature. It should be borne in mind that the reactants have been preheated in the gas preheater.

Since the method of combustion and the reactor burner according to the invention are based on a continuous preheating of gas and combustion air until the oxidative combustion takes place, it is very important to provide a temperature profile that rises intensely also in the longitudinal direction of the rotational axis from the discharge opening of the burner towards the reaction zone, since the preheating temperature of gas and air can never be brought above the temperature of the medium communicating for the heat exchange, regardless of the heat content in the said medium. The volume of the high temperature zone should therefore be as limited as possible in order certainly to maintain combustion, in particular in the case of waste gases having a low concentration of combustible components.

The temperature profile rising in the longitudinal direction of the burner towards the reaction zone is obtained by leading gas and air in rotating countercurrent to the hot products of combustion and with the use of a spiral-formed guiding vane 32 for rotation of the combustion air. The guiding vane 32 reduces the loss of heat in the preheaters, at the same time acting as a reflector for the reflected radiation of the temperature.

The products of combustion in heat exchange with the gas and air are cooled, as a result of which the velocity of flow of these in a burner pipe of constant diameter will decrease correspondingly to a Venturi tube having the form of the temperature profile. With the use of the burner, for example in the combustion of exhaust gas, the burner may therefore be made of simple tubular components, at the same time achieving that the exhaust by injector effect sucks in the combustion air whereby an air pump on the combustion engine may be dispensed with and the cost of the burner unit may be reduced. The principle of using tubular components is shown in FIG. 1 which also shows the rotary symmetrical shell-formed first part 10*a* with inlets 14 of the gas preheater in which part the temperature of the gas is equalized, and the rotary symmetrical second part 10*b* of the gas preheater with free access for the gas to the rotational axis for achieving a relative increase in concentration of reactive components for combustion. FIG. 1 shows on the inner tube 2 the spiral-formed guiding vane 32 which ensures that the combustion air is rotated and that the heat loss by temperature radiation in the preheaters is reduced.

FIG. 1 shows an embodiment of the reactor burner for combustion of exhaust gas received in the burner at a high temperature. The extent of the gas preheater is therefore limited in relation to the air preheater. FIG. 2 shows an embodiment of the reactor burner, in which both gas and air are fed at low temperature at inlets 14 and 3 respectively. In this case both the gas and the air preheater may be provided with guiding vanes to ensure their rotation.

FIG. 3 shows an embodiment according to the invention in which the gas preheater is a tube coil 33 mounted in the air preheater 4*b* as an additional advantage of which the organic fuel may be fed in its liquid state by means of a feeding pipe stub 34 provided at the bottom of the tube coil 33 and then moved towards a field of rising temperature in the gas preheater.

An additional advantage obtained hereby is that the liquid fuel is preheated, gasified, and that the gas is subsequently preheated to a temperature suitable for combustion. In this way it is, for example, possible for a distilled fuel oil to burn completely with great burning capacity, the process of combustion having been separated from preheating and gasification of the fuel oil in addition to which it is separated from preheating of gas and combustion air.

Cracking of the fuel oil is avoided or substantially reduced in the embodiment illustrated, fuel oil and gas being preheated continuously without being subjected to high temperature shocks.

FIG. 3 shows an embodiment in which the heat loss through the inner heat insulation 22*b* of the burner is accumulated in the cold combustion air which is introduced into a heat-insulated channel 4*a* surrounding the burner. This improvement of the burner according to the invention ensures a very small loss of heat from the surface of the burner even though the combustion process takes place in the burner at a high temperature, the heat lost through the inner heat insulation 22*b* being accumulated in the cold combustion air which is continuously advanced through the outer air channel 4*a* until it is introduced into the inner air channel 4*b*. As a result, the combustion air is preheated somewhat, but to such a low temperature however, that it is possible to make an effective heat insulation 22*a* of the outer air channel by means of known heat-insulating materials, by which a very high percentage of the thermal energy developed leaves the burner to be used for desired pruposes.

The general principle according to the invention for reducing a useless loss of heat from burner units in order to improve the combustion is characterised in that the combustion takes place in the center of the shells of heat-insulating materials and that one or more heat-accumulating media, for example gas and air, are advanced continuously, for example while being rotated in the spaces between the shells towards the process of combustion in the center by means of guides likewise made of heat-conducting materials. The rotation of heat-accumulating media, reactants and products of combustion concentrates the high temperature zone around the axis of symmetry with very limited extent. The axis of rotation is radially surrounded by concentric shells of heat-accumulating media or heat insulation of continuously decreasing temperature.

I claim:

1. In a method for combustion of gaseous fuels and flue gases, employing excess combustion air and partial transfer of the heat content of the combustion products and the combustion process by heat exchange with combustion air and gas, back to reactants participating in the combustion process, the improvement comprising the steps of rotating about and along a longitudinal axis the combustion gas separately from the combustion air to the extent necessary for said combustion gas to attain an approximately uniform temperature at least at the ignition point of a corresponding gas/air mixture, feeding said gas tangentially into a rotary symmetrical combustion chamber at a point displaced from the axis of symmetry thereof, the gas having free access to flow to said axis of symmetry, feeding said combustion air separately into said combustion chamber and transferring heat escaping from the combustion chamber by conduction through the walls of the combustion chamber to at least one of the reactants to participate in the combustion process prior to introduction thereof into the combustion chamber.

2. A method according to claim 1 in which at least one of the reactants participating in the combustion process is conveyed toward the combustion chamber in rotary countercurrent to the hot products of combustion.

3. A method according to claim 2 in which both the combustion air and the gas, separated in mutual heat exchange, are conveyed toward the combustion chamber in rotary countercurrent to the hot products of combustion.

4. A process according to claim 1 wherein said reactants are rotated while being conveyed toward the combustion chamber.

* * * * *